US009097057B2

(12) United States Patent
Pendleton et al.

(10) Patent No.: US 9,097,057 B2
(45) Date of Patent: Aug. 4, 2015

(54) LOCKING MECHANISMS FOR SAFES, SUCH AS GUN SAFES

(75) Inventors: Bruce Pendleton, Loganville, GA (US); Scott Mercer, Kings Mountain, NC (US)

(73) Assignee: Pendleton Safe Company, Loganville, GA (US)

( * ) Notice: Subject to any disclaimer, the term of this patent is extended or adjusted under 35 U.S.C. 154(b) by 856 days.

(21) Appl. No.: 12/689,720

(22) Filed: Jan. 19, 2010

(65) Prior Publication Data

US 2011/0174199 A1 Jul. 21, 2011

(51) Int. Cl.

| | |
|---|---|
| ***E05G 1/04*** | (2006.01) |
| ***E05B 17/20*** | (2006.01) |
| ***E05B 47/06*** | (2006.01) |
| ***E05B 65/00*** | (2006.01) |
| ***F41C 33/06*** | (2006.01) |

(52) U.S. Cl.

CPC ..... *E05G 1/04* (2013.01); *E05B 17/2038* (2013.01); *E05B 47/06* (2013.01); *E05B 65/0082* (2013.01); *F41C 33/06* (2013.01)

(58) Field of Classification Search

USPC ..... 109/58, 59 R, 64, 73, 74; 70/101, 102, 70/103, 104, 108, 113, 118

See application file for complete search history.

(56) References Cited

U.S. PATENT DOCUMENTS

| | | | | | |
|---|---|---|---|---|---|
| 3,418,951 | A * | 12/1968 | Belew | 109/59 R |
| 4,099,808 | A * | 7/1978 | Oakley et al. | 109/50 |
| 4,446,798 | A * | 5/1984 | Withington | 109/59 R |
| 4,665,727 | A * | 5/1987 | Uyeda | 70/279.1 |
| 4,754,715 | A * | 7/1988 | Squires | 109/74 |
| 5,094,483 | A * | 3/1992 | James | 109/59 R |
| 5,245,846 | A * | 9/1993 | James | 109/59 R |
| 5,778,708 | A * | 7/1998 | Crosby et al. | 109/59 R |
| 5,784,973 | A * | 7/1998 | Mercer et al. | 109/59 R |
| 5,970,890 | A * | 10/1999 | Harry et al. | 109/73 |
| 6,089,168 | A * | 7/2000 | Dunlap et al. | 109/59 R |
| 6,679,087 | B2 * | 1/2004 | Suggs et al. | 109/59 R |
| 6,865,993 | B2 * | 3/2005 | Bartel et al. | 109/70 |
| 7,641,106 | B1 * | 1/2010 | Kovacs et al. | 109/59 R |
| 7,665,405 | B2 * | 2/2010 | Evans et al. | 109/59 R |
| 8,276,527 | B2 * | 10/2012 | Stepp | 109/59 R |
| 8,347,665 | B2 * | 1/2013 | Rasmussen et al. | 109/59 R |

* cited by examiner

*Primary Examiner* — Christopher Boswell

(74) *Attorney, Agent, or Firm* — Brient Globerman, LLC

(57) ABSTRACT

A safe (e.g., a gun safe) according to various embodiments comprises: (A) a housing defining an interior portion and an opening; (B) a door disposed adjacent the opening, the door being mounted to move between: (1) a closed position, in which the door prevents access to the interior portion; and (2) an open position, in which the door does not prevent access to the interior portion; and (C) a locking mechanism for maintaining the door in the closed position. In particular embodiments, the locking mechanism comprises a lock bar defining at least one elongated (e.g., substantially planar) tab, the lock bar being mounted to slide between: (1) a locked position, in which at least a particular portion of the elongated tab is disposed in an opening defined by the housing; and (2) an unlocked position, in which the particular portion of the elongated tab is not disposed in the opening.

22 Claims, 11 Drawing Sheets

LOCKING MECHANISMS FOR SAFES, SUCH AS GUN SAFES

BACKGROUND OF THE INVENTION

Current gun safes are typically in the form of an upright, rectangular, metal box that includes a rectangular door on the front of the box. The locking mechanisms used with these safes typically include four to five cylindrical metal bolts that slide into corresponding circular cutouts adjacent the safe's door as the door is locked. These openings are often cutouts in unreinforced strips of sheet metal. As demonstrated by the many gun safe "pry test" videos that have been widely distributed on Internet sites, such as www.youtube.com, these locking mechanisms are often easy to defeat using primitive tools such as pry bars and sledge hammers. Accordingly, while such locking mechanisms may be suitable to prevent children and visitors from stealing guns and other valuables from a gun safe, they typically do not offer effective protection from determined criminals.

Also, most standard gun safes have flat rear surfaces. This allows a criminal to knock a standard gun safe onto its rear surface so that the gun safe's door is stably maintained in an elevated horizontal orientation. This provides the criminal with a convenient, stable working platform for prying the safe's door open.

In light of the above, there is a need for gun safes, and other types of safes, that are more secure.

SUMMARY OF VARIOUS EMBODIMENTS OF THE INVENTION

A safe (e.g., a gun safe) according to various embodiments comprises: (A) a housing defining an interior portion and an opening; (B) a door disposed adjacent the opening, the door being mounted to move between: (1) a closed position, in which the door prevents access to the interior portion; and (2) an open position, in which the door does not prevent access to the interior portion; and (C) a locking mechanism for maintaining the door in the closed position. In particular embodiments, the locking mechanism comprises a lock bar defining at least one elongated tab, the lock bar being mounted to slide between: (1) a locked position, in which at least a particular portion of the elongated tab is disposed in an opening defined by the housing; and (2) an unlocked position, in which the particular portion of the elongated tab is not disposed in the opening.

A safe according to particular embodiments of the invention comprises: (A) a housing defining an interior portion and an opening; (B) a door disposed adjacent the opening, the door being mounted to move between: (1) a closed position, in which the door prevents access to the interior portion; and (2) an open position, in which the door does not prevent access to the interior portion; and (C) a locking mechanism for maintaining the door in the closed position. In particular embodiments, the locking mechanism comprises a lock bar defining a plurality of elongated lock bar tabs, the lock bar being mounted to slide between: (1) a locked position, in which at least a particular portion of each respective one of the elongated lock bar tabs is disposed in a respective opening defined by the housing; and (2) an unlocked position, in which the respective particular portions of the respective lock bar tabs are not disposed in the respective openings. In various embodiments, the plurality of lock bar tabs are positioned in a vertical array adjacent a first lateral side of said door.

BRIEF DESCRIPTION OF THE DRAWINGS

Figure 1A:
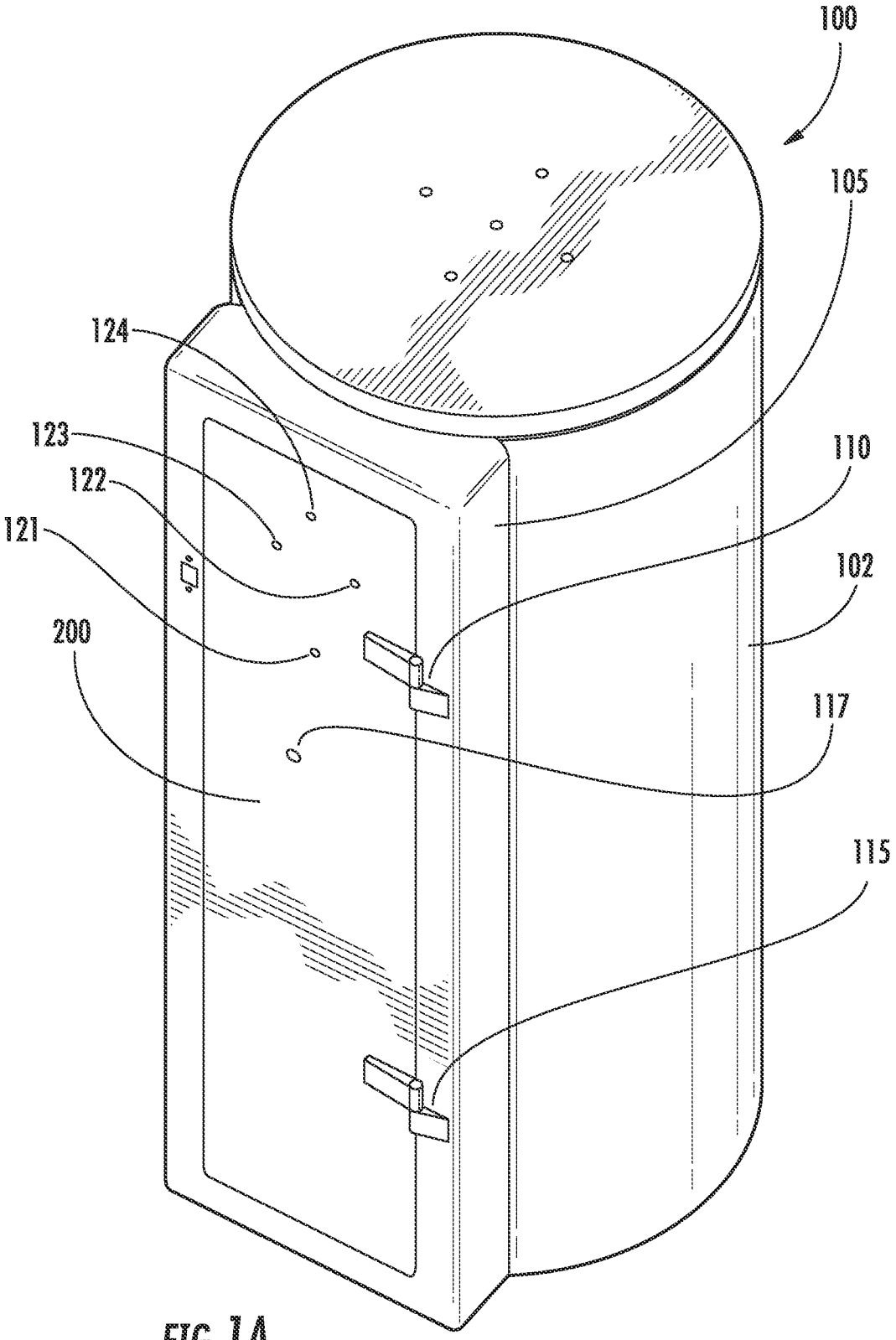

Having thus described various embodiments of the invention in general terms, reference will now be made to the accompanying drawings, which are not necessarily drawn to scale, and wherein:

FIG. 1A is a perspective view of a gun safe according to a particular embodiment of the invention. In this figure, the gun safe's handle and combination lock are shown removed.

Figure 1B:
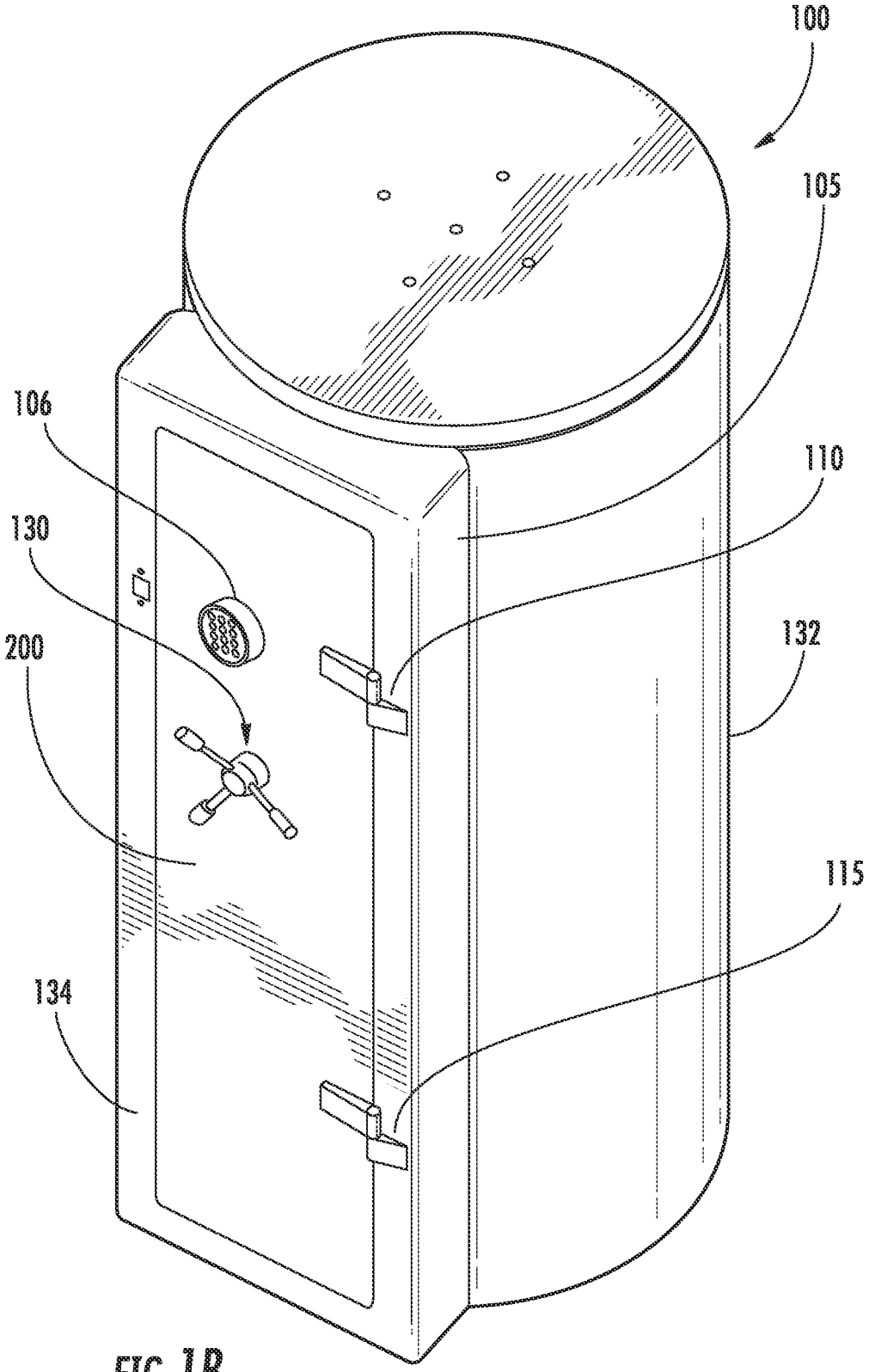

FIG. 1B is a perspective view of a gun safe according to a particular embodiment of the invention. In this figure, the gun safe's handle and combination lock are shown installed.

Figure 1C:
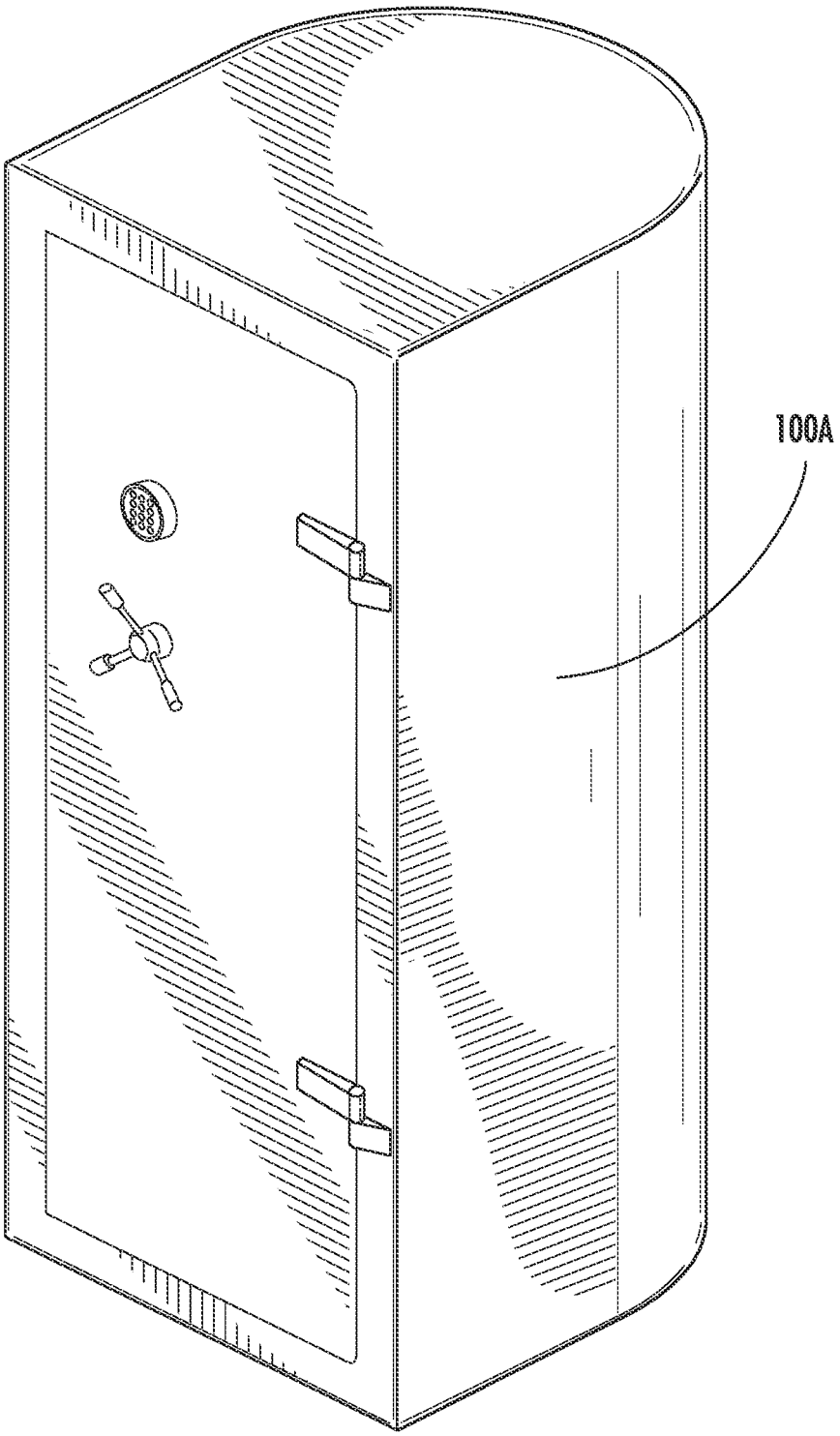

FIG. 1C is a perspective view of an alternative gun safe design that is suitable for use with boltwork according to various embodiments of the invention.

Figure 2:
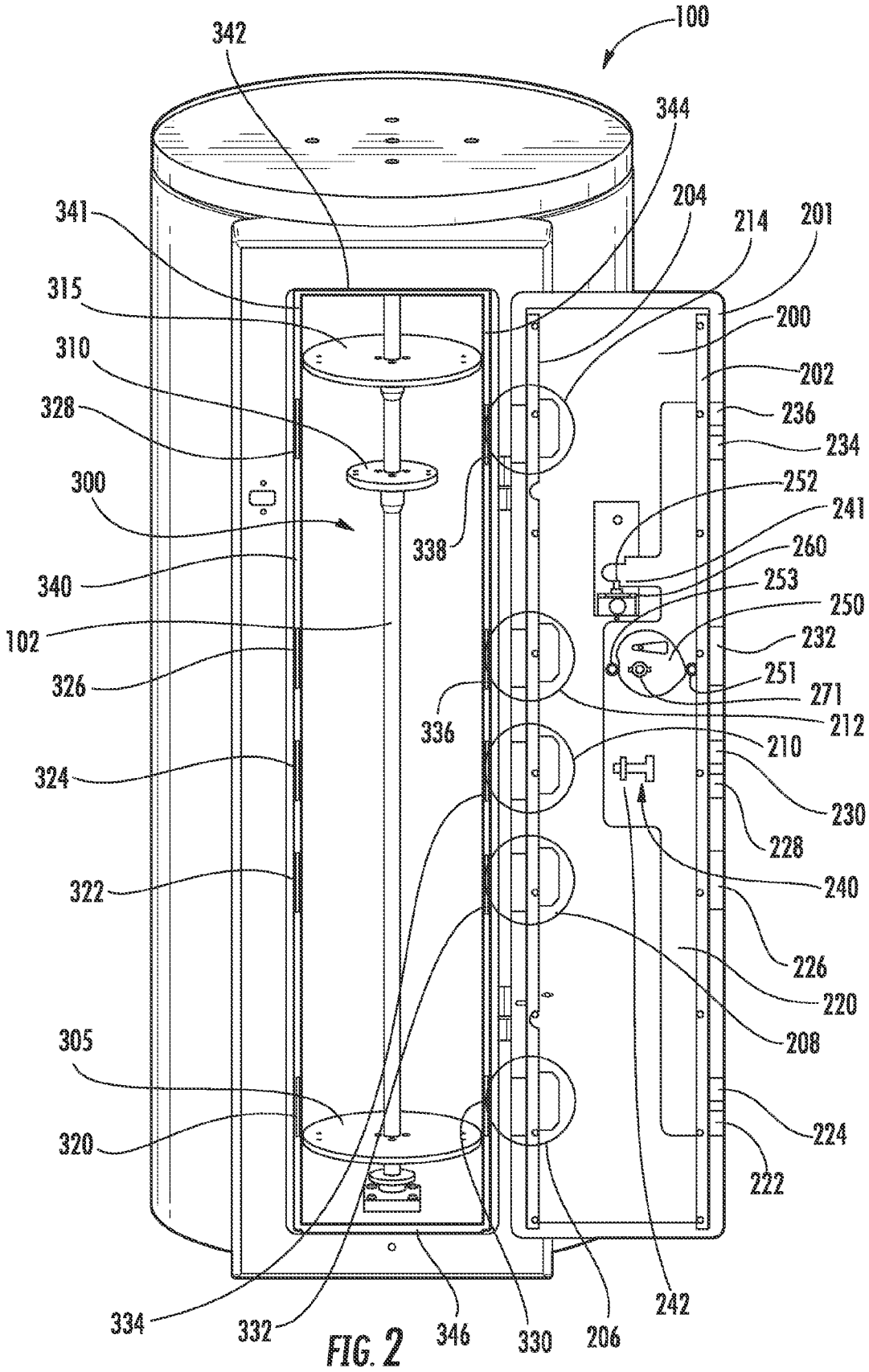

FIG. 2 is a perspective front view of the gun safe of FIGS. 1A and 1B. In this figure, the gun safe's access door is shown open, and the storage shelves of the gun safe are shown removed.

Figure 2A:
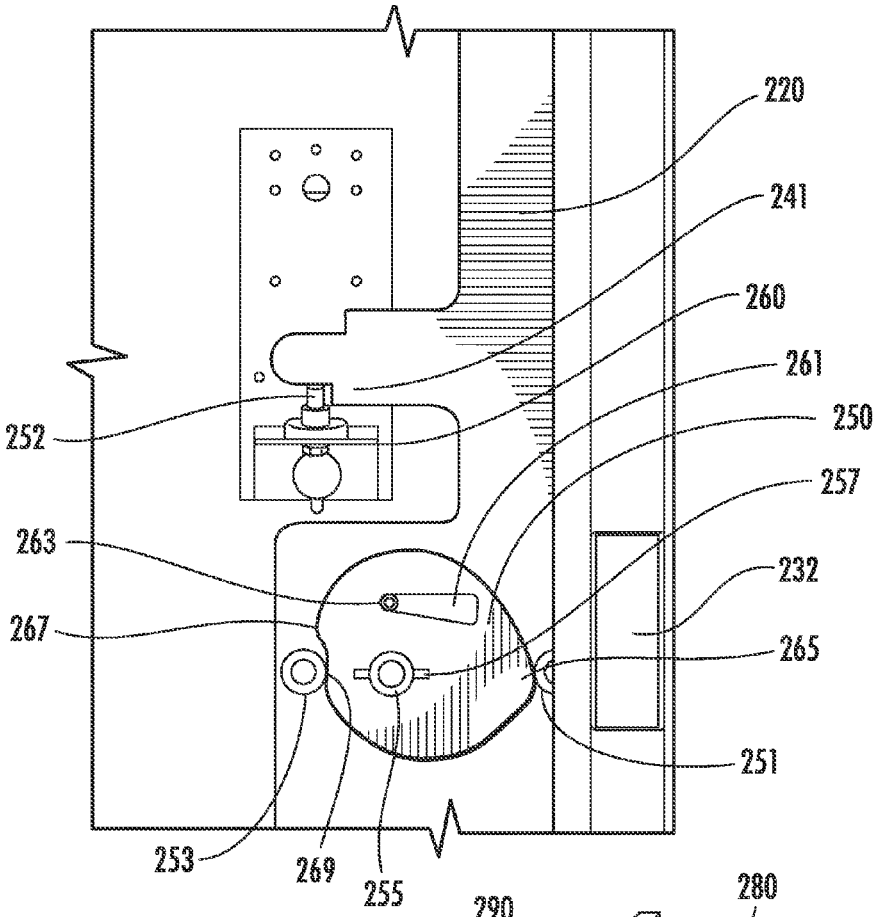

FIG. 2A is an enlarged view of a portion of the boltwork shown in FIG. 2 in which the safe's lock has been omitted.

Figure 2B:
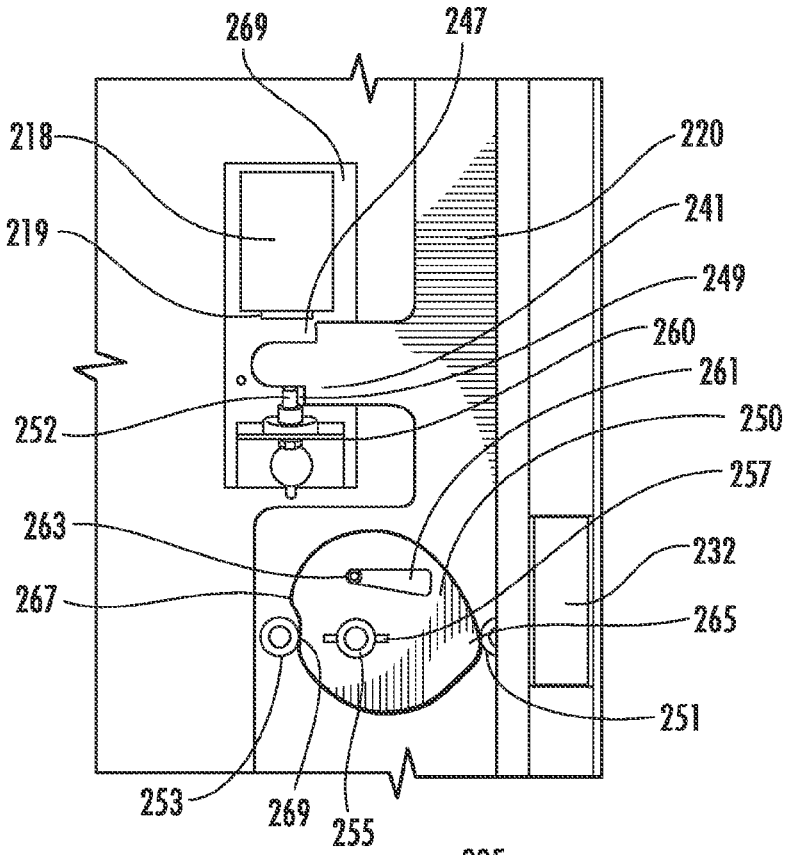

FIG. 2B is an enlarged view of a portion of the boltwork shown in FIG. 2 in which the safe's lock is shown.

Figure 2C:
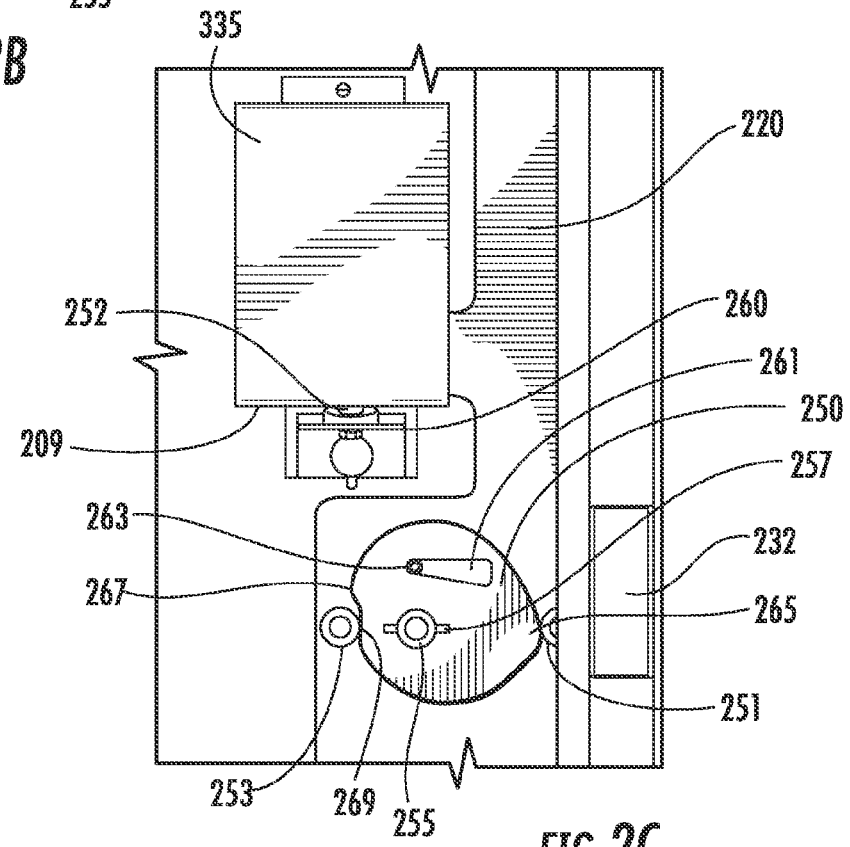

FIG. 2C is an enlarged view of a portion of the boltwork shown in FIG. 2 in which a pan is shown covering the safe's lock.

Figure 3:
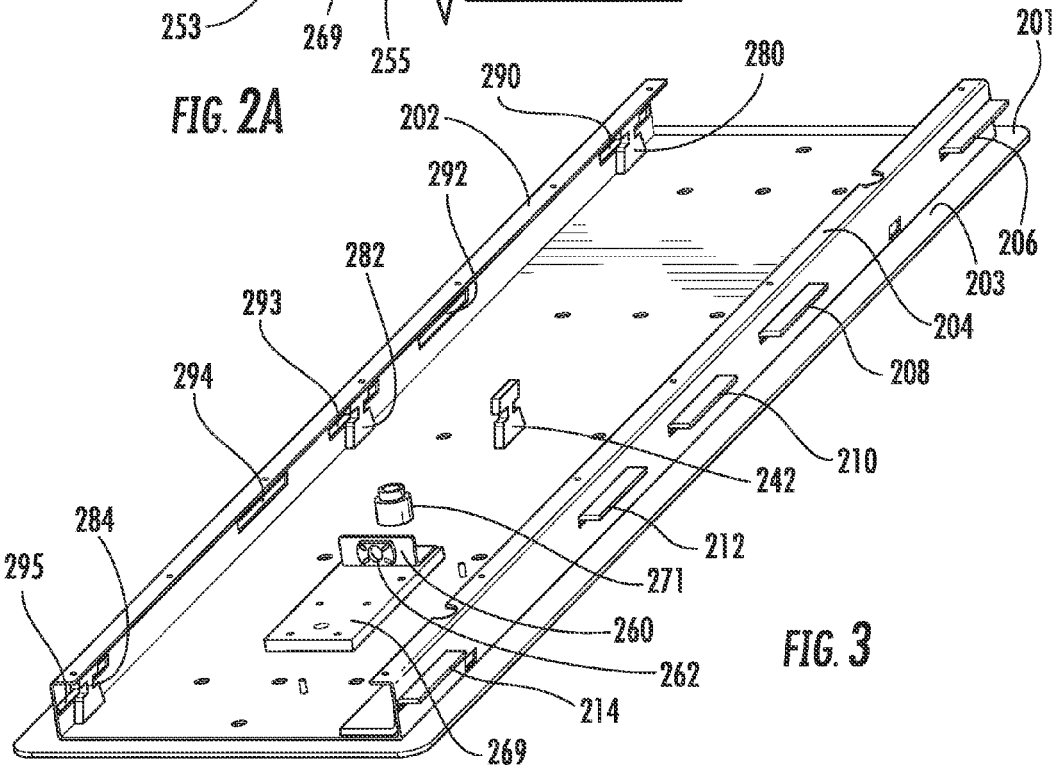

FIG. 3 is an isometric view of the door weld of the safe of FIGS. 1A and 1B.

Figure 4:
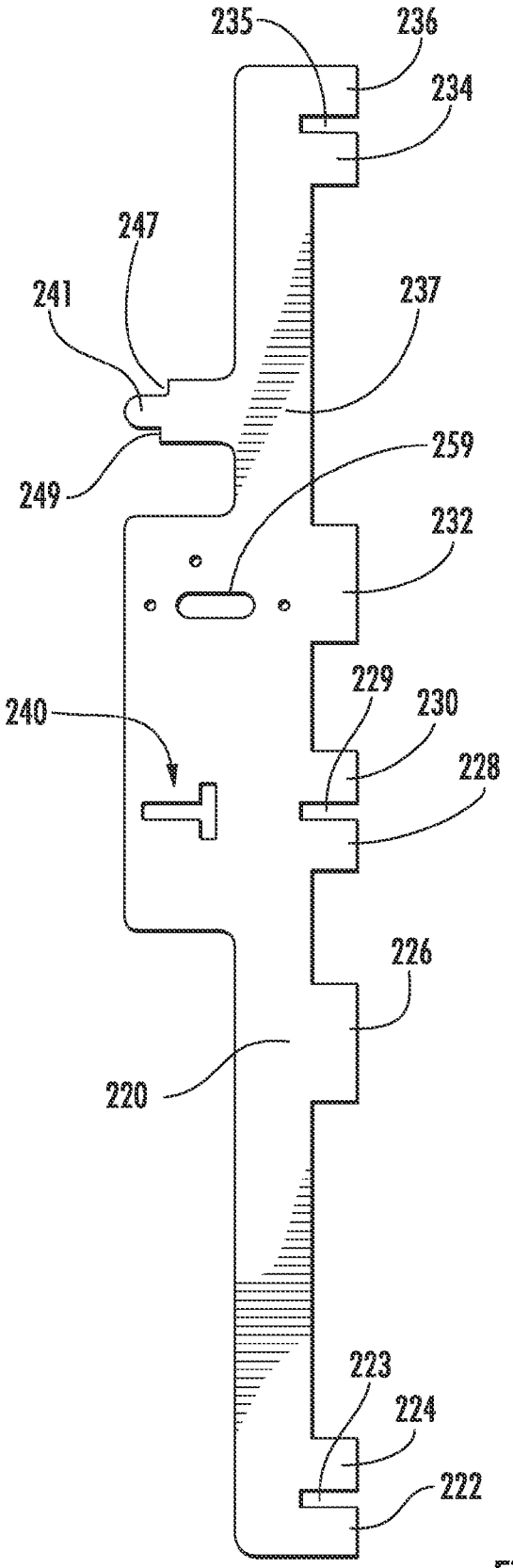

FIG. 4 is a front elevation view of the lock bar of the safe of FIGS. 1A and 1B.

Figure 5:
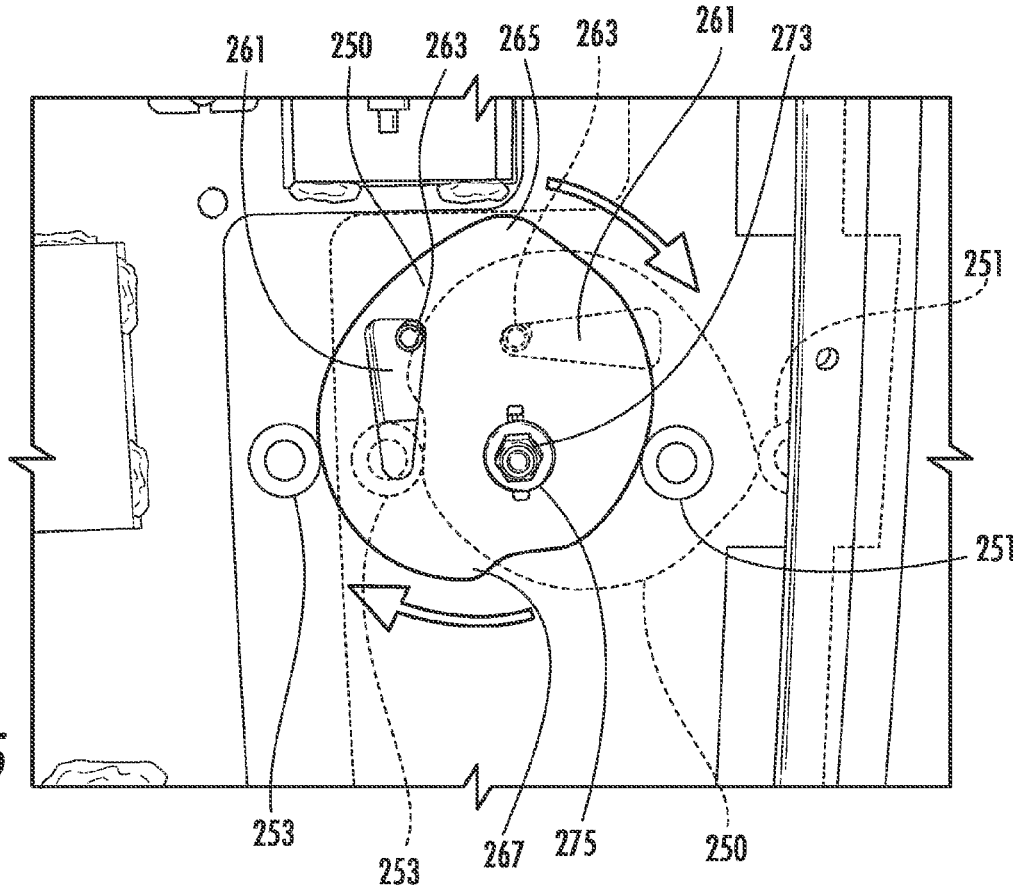

FIG. 5 shows the operation of the cam mechanism of the safe of FIGS. 1A and 1B.

Figure 6:
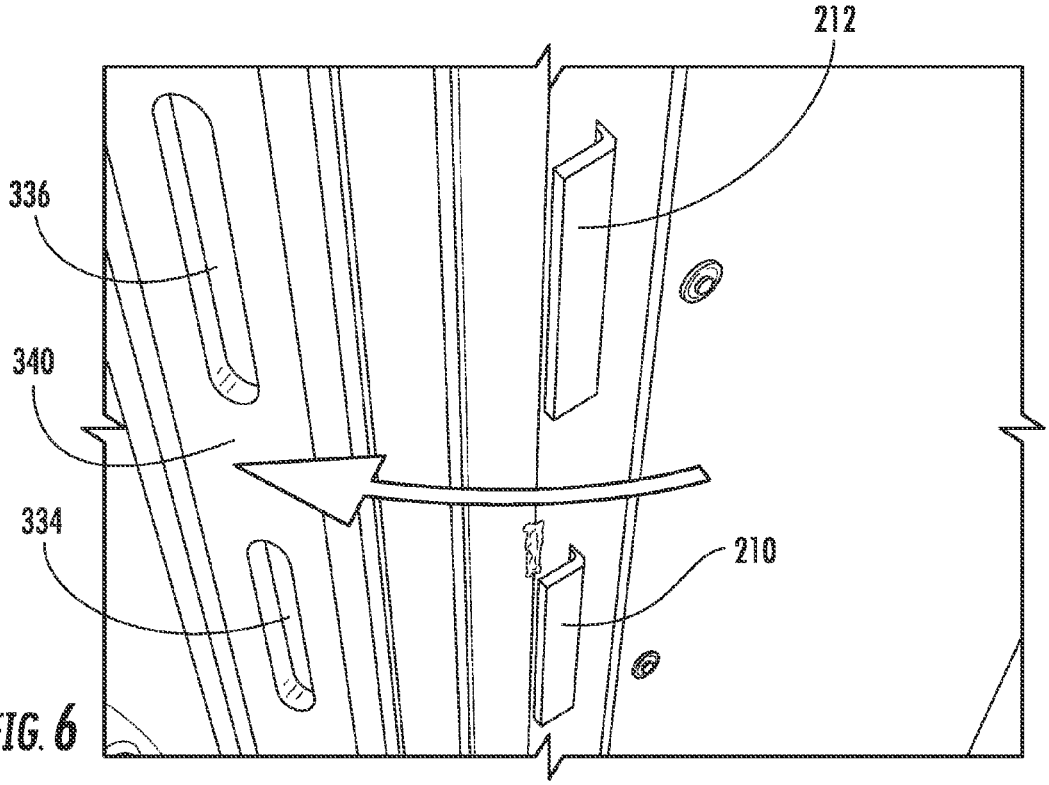

FIG. 6 is a perspective top view of exemplary lock bolts of the safe of FIGS. 1A and 1B.

Figure 7:
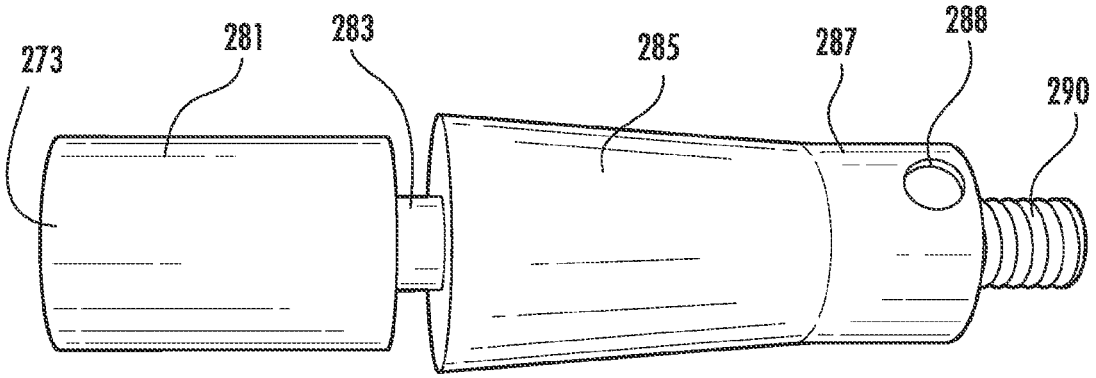

FIG. 7 is a side elevation view of the tapered spindle of the safe of FIGS. 1A and 1B.

Figure 8:
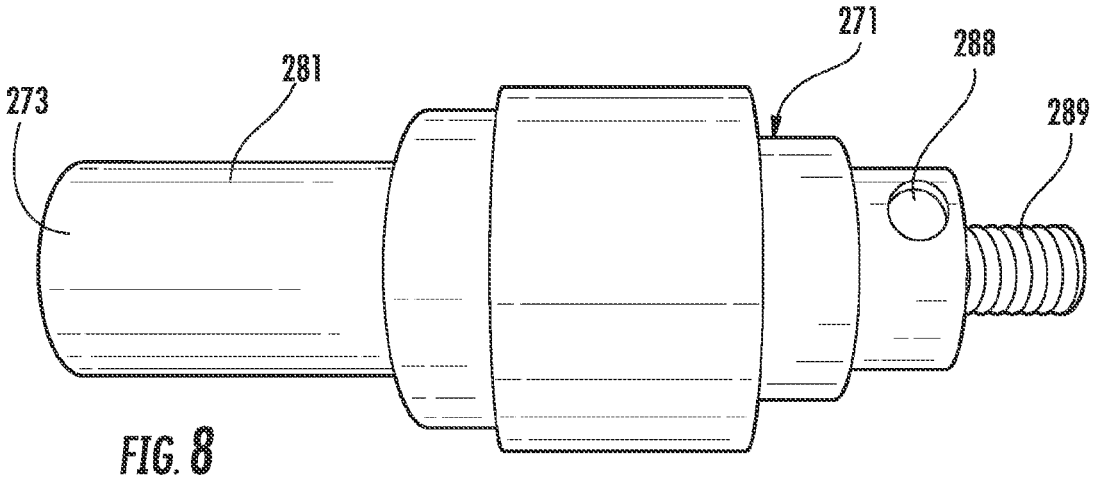

FIG. 8 is a side elevation view of the tapered spindle of FIG. 7 and the safe's spindle support sleeve.

Figure 9:
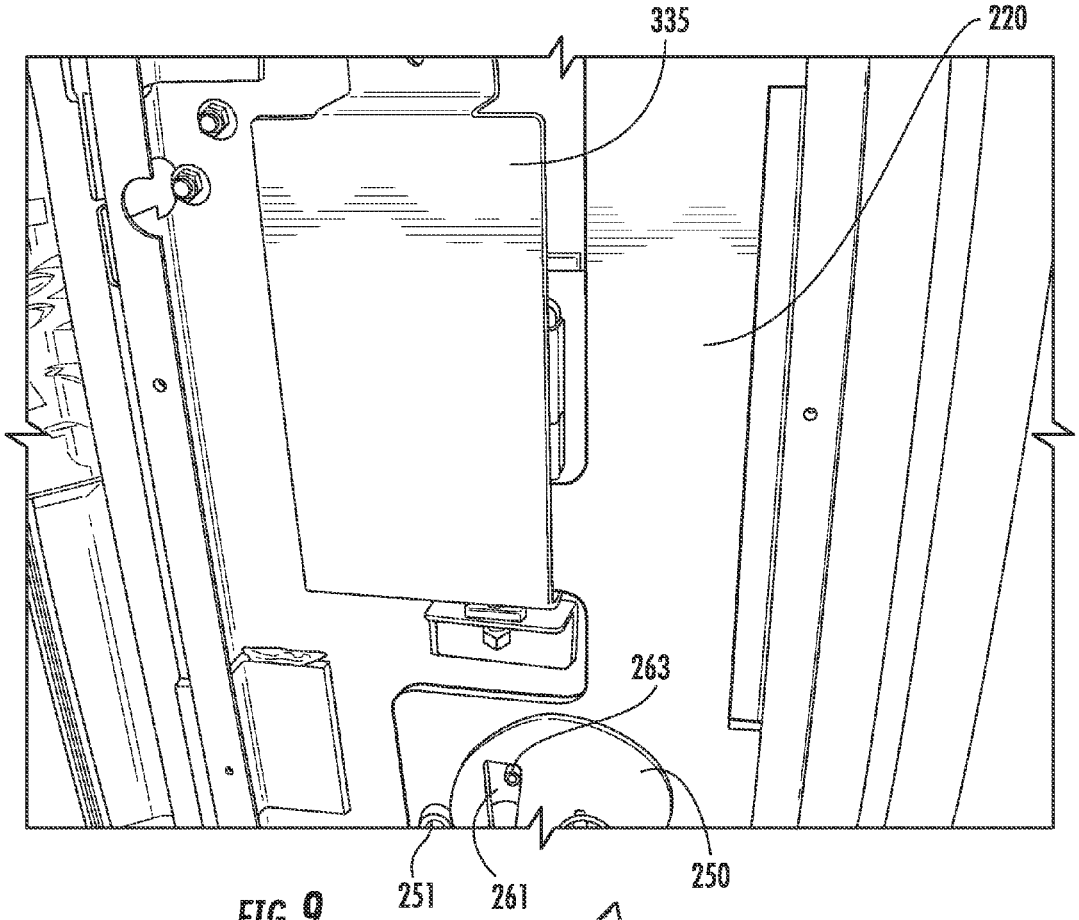

FIG. 9 shows an exemplary locking mechanism pan cover that is suitable for use with the gun safe of FIGS. 1A and 1B.

Figure 10:
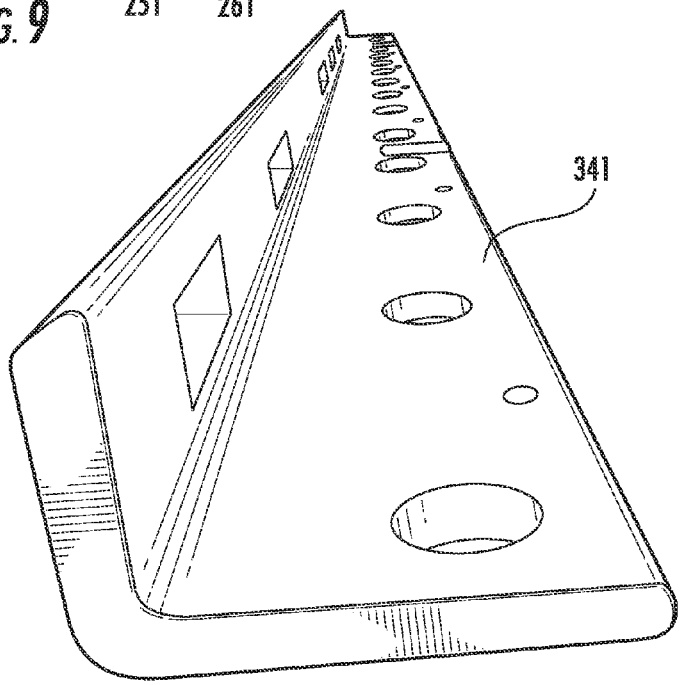

FIG. 10 is a perspective end view of the first strike plate of the safe shown in FIGS. 1A and 1B.

Figure 11:
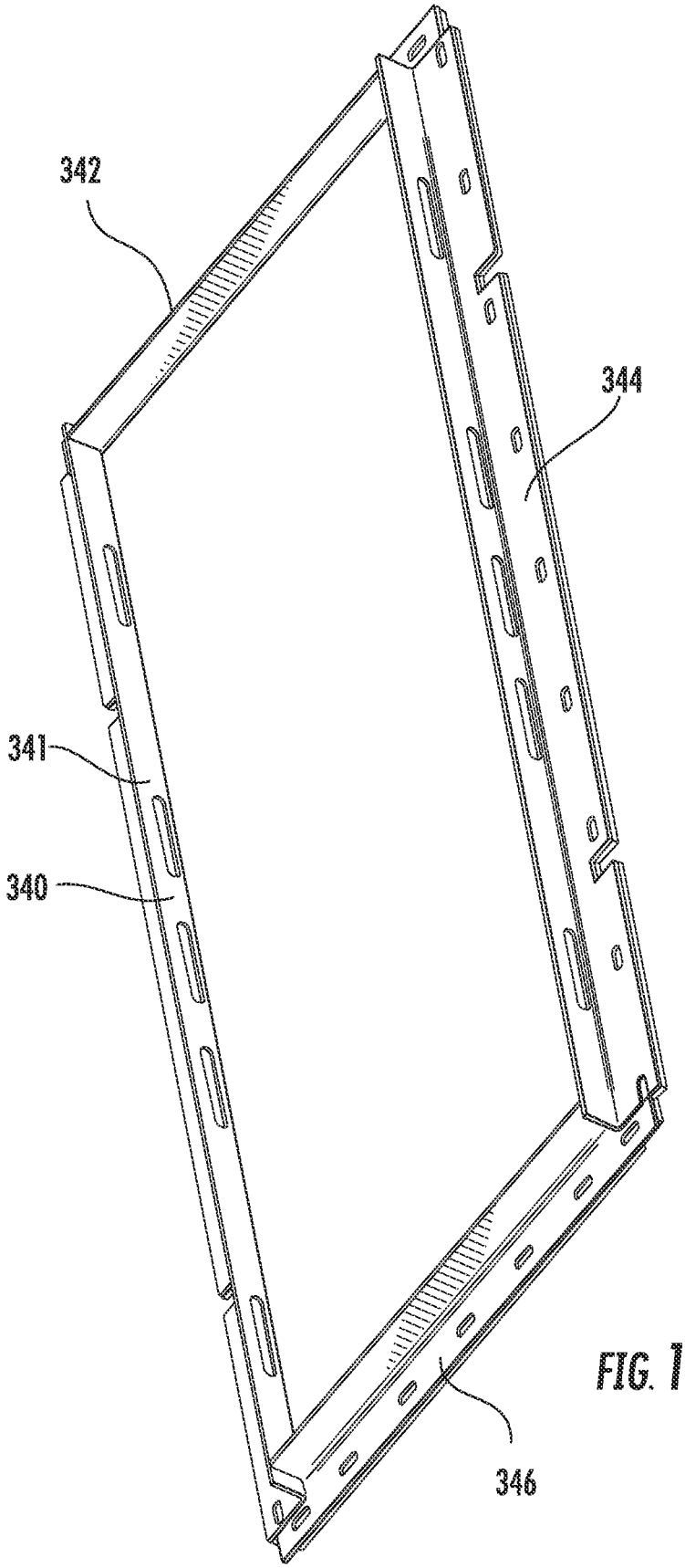

FIG. 11 is a perspective view of the door frame of the safe shown in FIGS. 1A and 1B.

DETAILED DESCRIPTION OF VARIOUS EMBODIMENTS OF THE INVENTION

Various embodiments of the present invention will now be described more fully hereinafter with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

General Structure of Exemplary Gun Safe

As shown in FIGS. 1A, 1B, and 2, a gun safe 100 according to a particular embodiment of the invention comprises a substantially cylindrical outer housing 102 that defines a thin, elongate, upright, rectangular access passage 105 that extends radially outwardly from an outer side portion of the substantially cylindrical outer housing 102. A thin rectangular access door 200 is mounted at the outer end of this access passage 105.

The outer housing 102 defines an interior portion that is dimensioned for storing a plurality of rifles, and the access door 200 is adapted to selectively restrict (e.g., prevent) access to this interior portion. In particular embodiments, the access door 200 includes a locking mechanism (e.g., a combination lock 218) that is adapted for selectively maintaining the access door 200 in a closed and locked orientation in which the access door 200 prevents access to the outer housing's interior portion.

As shown in FIGS. 2-4, in various embodiments, the gun safe 100 includes a rotatable interior gun support assembly 300 that is adapted to support rifles in an upright position adjacent a perimeter of a portion of the gun support assembly 300. For example, in particular embodiments, the gun support assembly 300 includes a substantially circular, substantially horizontal, rotatable gun barrel support member that is adapted to support rifles in at least a substantially upright position adjacent its outside perimeter. FIG. 2 shows a series of supports 305, 310, 315 on which the gun safe's various gun supports are mounted. Examples of gun supports (e.g., shelves) suitable for use with safes according to various embodiments of the invention, are shown in U.S. patent application Ser. No. 12/492,425, entitled "Safes with Rotating Inner Supports", which was filed on Jun. 26, 2009 and which is hereby incorporated by reference.

In particular embodiments, the gun support assembly includes a central, vertical shaft 102 that extends substantially through a center portion of the gun support assembly 300. This shaft 102 is preferably rotatably mounted on bearings (not shown) at the top and bottom of the shaft 102. In particular embodiments, these bearings are attached, respectively, approximately adjacent the center of the ceiling and floor of the gun safe 100.

It should be understood that, while the safe shown in FIGS. 1A and 1B includes a substantially circular cross section, the safe may alternatively have a cross section of another general shape. For example, the safe could have a cross-section that is generally rectangular with a rear face that is bowed outwardly in a smooth arc (See FIG. 1C).

Exemplary Locking Mechanisms

FIGS. 1-11 show exemplary gun safes, and specifically show particular embodiments of the safe's locking mechanism. Applicants note that while various embodiments are described below in relation to a gun safe (which may, for example, be used as a freestanding gun safe), the locking mechanisms described herein may be used in conjunction with a variety of other types of safes and other secure enclosures.

Structure of Exemplary Locking Mechanisms

The basic structure of particular exemplary locking mechanisms is described below. This structure may include, for example, a lock bar, a door frame, a door structure (which is part of the safe's door assembly), and a lock. These various components are discussed in greater detail below.

Lock Bar

A lock bar 220 according to a particular embodiment of the invention is shown in FIGS. 2, 2A, 4, and 5. As may be generally understood from FIG. 2, the lock bar 220 is slideably mounted adjacent (e.g., to) the interior side of the gun safe's access door 200 so that the lock bar 220 may slide between: (1) a locked position in which the lock bar 220 maintains the safe's access door 200 in a locked position (e.g., prevents the door from being opened under the force of human strength); and (2) an unlocked position in which the lock bar 220 does not maintain the safe's access door 200 in a locked position (e.g., does not prevent the door from being opened under the force of human strength).

In various embodiments of the invention, such as the embodiment shown in FIG. 4, the lock bar 220 is substantially planar (e.g., planar), and is comprised of a hard metal, such as steel. However it should be understood that the lock bar 220 may, in alternative embodiments, not be entirely planar, and that it may be made of other suitable materials.

As may be understood from FIG. 4, the exemplary lock bar 220 includes an elongated, substantially rectangular central portion 237. The lock bar 220 further includes a plurality of elongated tabs (e.g., substantially rectangular, substantially planar tabs) 222, 224, 226, 228, 230, 232, 234, 236 that extend from a first lateral side of the lock bar's central portion 237. In particular embodiments, two of these tabs 222, 224, which are defined adjacent the bottom end of the lock bar 220, cooperate to define a first recess 223 in the lock bar 220. Similarly, two of the tabs 228, 230, which are defined adjacent the central portion of the lock bar 220 cooperate to define a second recess 229 in the lock bar 220. By the same token, two of the tabs 234, 236 that are defined adjacent the top end of the lock bar 220 cooperate to define a third recess 235 in the lock bar 220. In various embodiments, the lock bar 220 includes at least one (e.g., two, three, or four) additional tabs 226 and 232 that may, for example, be at least twice as tall as the lock bar's other tabs 222, 224, 228, 230, 234, and 236.

In particular embodiments, the lock bar 220 includes an elongated lock engaging tab 241 that defines a top recess 247 and a bottom recess 249. The lock bar 220 further defines: (1) a lateral elongated cutout 259 that is defined within a central portion of the lock bar 220; and (2) a keyhole support cutout 240 that is also defined within the central portion of the lock bar 220. In a particular embodiment of the invention, and as may be understood from FIG. 4, the keyhole support cutout 240 is substantially T-shaped with the base portion of the "T" being substantially horizontal and substantially in-line with the second elongated recess 229. In particular embodiments, the top portion of the "T" of the support cutout 240 is substantially vertical. It should be understood, in light of this disclosure, that the keyhole support cutout may be of any of a variety of other suitable shapes.

Door Frame

A door frame 340 according to a particular embodiment of the invention is shown in FIGS. 2 and 11. As may be understood from these figures, the door frame 340 is a substantially rectangular frame that comprises: (1) a first strike plate 341 and a second strike plate 344 that define the respective lateral sides of the door frame 340; (2) an upper door frame portion 342 that defines the upper portion of the door frame 340; and (3) a lower door frame portion 346 that defines the lower portion of the door frame 340. In particular embodiments these four frame components are each steel structural angle (e.g., ¼", ½, or ⅜" structural angle) and are attached together in any suitable manner to form an integrated door frame.

In particular embodiments, the first strike plate 341 defines a plurality (e.g., five or other suitable number) of cutouts 320, 322, 324, 326, 328 that are each dimensioned to receive (and, in various embodiments, substantially mate with) a respective elongate tab 222, 224, 226, 228, 230, 232, 234, 236 of the lock bar 220. (See FIG. 2.) Similarly, as described above, the second strike plate 344 defines a plurality (e.g., five or other suitable number) of cutouts 330, 332, 334, 336, 338 that are each dimensioned to receive (and, in various embodiments, substantially mate with) an elongate tab of a respective lock bracket 206, 208, 210, 212, 214. (See FIGS. 2 and 6.)

Door Structure

A door structure 201 according to various embodiments is shown in FIG. 3. This door structure 201 comprises a substantially planar, substantially rectangular base portion 203.

The door structure 201 further includes an elongated lock bracket support 204 which, when the safe 100 is assembled and placed in an upright position, extends substantially vertically (e.g., vertically) adjacent an interior surface of the door's base portion 203. In particular embodiments, the lock bracket support 204 is positioned adjacent a first lateral side (e.g., the hinge side) of the door's base portion 203. In particular embodiments, the lock bracket support 204 is substantially U-shaped.

As may be understood from FIG. 3, the door structure 201 further includes a plurality of lock brackets 206, 208, 210, 212, 214 that, in various embodiments, are spaced vertically apart from each other in a substantially linear array along an outer edge of the lock support. In particular embodiments, the respective lock brackets 206, 208, 210, 212, 214 are positioned and dimensioned so that a tab of each respective lock bracket 206, 208, 210, 212, 214 is received into (and substantially mates with) a corresponding respective cutout 330, 332, 334, 336, 338 in the safe's door frame 340 when the safe's access door 200 is in a closed position. In various embodiments, the lock brackets 206, 208, 210, 212, 214 are elongated, and have a substantially L-shaped cross section. As shown in FIGS. 2 and 6 (e.g., in regard to particular lock bracket 212) each lock bracket 206, 208, 210, 212, 214 defines a respective lock tab that is positioned and dimensioned so that, when the safe's access door 200 is moved from an open to a closed position, the leading portion of the lock bracket's lock tab moves along a substantially arcuate path and through a respective cutout 330, 332, 334, 336, 338 in the safe's door frame 340. When the safe's door is in the closed position, the physical (e.g., mating) relationship between the substantially vertical array of lock tabs and the safe's door frame 340 serves to prevent the hinge side of the safe's door from being pried away from the door frame 340.

Turning again to FIG. 3, in particular embodiments, the door structure 201 further includes an elongated lock bar tab support bracket 202 which, when the safe 100 is assembled and placed in an upright position, extends substantially vertically (e.g., vertically) adjacent an interior surface of the door's base portion 203. In particular embodiments, the lock bar tab support bracket 202 is positioned adjacent a second lateral side of the door's base portion 203. In various embodiments, the lock bar tab support bracket 202 is substantially U-shaped.

As shown in FIG. 3, the lock bar tab support bracket 202 defines a plurality (e.g., five or any other suitable number) of cutouts 290, 292, 293, 294, 295 that are each dimensioned to receive (and, in various embodiments, substantially mate with) one or more elongate tabs 222, 224, 226, 228, 230, 232, 234, 236 of the lock bar 220.

In various embodiments, the safe's door structure 201 includes a plurality of lock bar supports 242, 280, 282, 284 that are mounted adjacent (e.g., on) the door's base portion 203. In the embodiment shown in FIG. 3, these lock bar supports 242, 280, 282, 284 are substantially I-shaped and extend outwardly from an interior surface of the door's base portion 203 (e.g., so that the lock bar supports 242, 280, 282, 284 are substantially perpendicular to the interior surface of the door's base portion 203). In particular embodiments, each of the lock bar supports 242, 280, 282, 284 is oriented at least substantially vertically (e.g., vertically) when the safe 100 is assembled and in an upright position. As a result of the I-shaped structure of the lock bar supports 242, 280, 282, 284, the lock bar supports each define two grooves—one on each lateral side of each respective lock bar support. These grooves are preferably substantially the same width as the thickness of the lock bar 220.

In the embodiment shown in FIG. 3, a plurality (e.g., three or other suitable number) of the lock bar supports 280, 282, 284 are positioned within a recess that is defined by the U-shaped lock bar tab support bracket 202. In various embodiments, each respective one of these supports 280, 282, 284 is positioned so that the central vertical portion of the support is positioned immediately adjacent the midpoint of a respective one of the cutouts 290, 293, 295 in the lock bar tab support bracket 202. This serves to effectively divide each of these respective cutouts 290, 293, 295 into two discrete openings that are defined by the physical cooperation between the respective lock bar tab support bracket 202 and the lock bar supports 280, 282, 284. In various embodiments, each of these discrete openings is dimensioned to receive (and, in certain embodiments, substantially mate with) a respective elongate tab 222, 224, 228, 230, 234, 236 of the lock bar 220. In particular embodiments, the discrete openings are positioned to simultaneously receive six tabs of the lock bar 220.

As shown in FIG. 3, a central one of the lock bar supports 242 is positioned adjacent a central portion of the door's base portion 203. This central lock bar support 242 may be substantially horizontally in-line with (e.g., horizontally in-line with) one of the other lock bar supports 280, 282, 284 described above. In the example shown in FIG. 3, the central lock bar support 242 is substantially horizontally in-line with the safe's middle lock bar support 282. The distal end of this central lock bar support 242 is preferably dimensioned: (1) so that it may pass through the vertical portion of the keyhole cutout 240 in the lock bar 220 when the central lock bar support 242 and lock bar 220 are installed as shown in FIG. 2; and (2) so that it may not pass through the horizontal portion of the keyhole cutout 240 when the central lock bar support 242 and lock bar 220 are installed as shown in FIG. 2. At least partially as a result of this structure, when the lock bar 220 is installed on the door structure 201, the lock bar 220 may slide laterally on the lock bar supports 242, 280, 282, 284 relative to the base portion of the door 203.

Turning again to FIG. 3, the safe's door structure 201 includes a mounting bracket 260 for the safe's relock mechanism (including an opening 262 for facilitating mounting the relock mechanism in place). The safe's door structure 201 further includes a rectangular mounting plate 269 for mounting the safe's lock 218 adjacent the safe's door. The relock mechanism mounting bracket 260 is disposed on a bottom portion of this mounting plate 266. The safe's door structure 201 further includes a substantially tubular spindle support sleeve 271 that is attached adjacent a central portion of the safe's door structure 201. This spindle support sleeve 271 is discussed further below.

Door Assembly

An exemplary door structure 201 according to a particular embodiment of the invention is shown in FIG. 2. As may be generally understood from this figure, when the door assembly is assembled, two bearings 251, 253 are attached adjacent (e.g., to) the lock bar 220 in the positions shown in FIGS. 5 and 2A. A user then positions the lock bar 220 so that the lock bar's elongated tabs 222, 224, 226, 228, 230, 232, 234, 236 fit into the respective corresponding cutouts 290, 292, 293, 294, 295 in the lock bar tab support bracket 202. (See FIGS. 3 and 4). While the lock bar's elongated tabs 222, 224, 226, 228, 230, 232, 234, 236 are disposed within the corresponding cutouts 290, 292, 293, 294, 295 in the lock bar tab support bracket 202, the user positions the lock bar's keyhole cutout 240 so that the vertical portion of the keyhole cutout 240 is immediately adjacent the top portion of the central lock bar support 242.

The user then rotates the lock bar 220 slightly toward the central lock bar support 242 so that the top portion of the central lock bar support 242 passes through the vertical portion of the keyhole cutout 240. The user then slides the lock bar 220 laterally toward the lock bar tab support bracket 202 until the central lock bar support 242 is adjacent the narrower horizontal portion of the keyhole cutout 240. When the lock bar 220 is in this position, the lock bar 220 is mounted to slide between a locked and an unlocked position without separating from the rest of the door structure.

The user then obtains a tapered spindle, such as the tapered spindle 273 shown in FIG. 7. As may be understood from FIG. 7, this tapered spindle comprises: (1) a substantially cylindrical handle support portion 281; (2) a substantially cylindrical ring-off portion 283 (which may, for example, have a diameter that is smaller than the diameter of the handle support portion 281); (3) a tapered portion 285 that is, in various embodiments, in the shape of a conical frustum that has its base adjacent the ring-off portion 283; (4) a substantially cylindrical roll pin receiving portion 287 that defines a roll pin opening 288 adjacent its distal end; and (5) a threaded portion 290 that defines the distal end of the tapered spindle 273. In particular embodiments, the tapered spindle 273 is comprised of the elements listed above and the elements are arranged, from left-to-right in FIG. 7, in the order listed above. Furthermore, the elements are arranged so that the major axis of each element corresponds to the overall major axis of the tapered spindle 273 as shown in FIG. 7.

In various embodiments, the user then feeds the tapered spindle 273 into a substantially circular opening 117 (see FIG. 1A) in the central portion of the base portion 203 of the safe's access door 200. The user then continues to feed the tapered spindle 273 into the circular opening 117 until the tapered spindle 273 is in an installed position in which: (1) a length of the tapered spindle 273 extends through the substantially circular opening 117 and through the safe's spindle support sleeve 271. (See generally FIG. 3, and also FIG. 8, which shows the spindle in the installed position within the spindle support sleeve 271.)

Turning to FIGS. 2, 2A, and 5, after the tapered spindle 273 is placed in the installed position referenced above, a cam 250 is attached adjacent (e.g., to) the threaded end 290 of the tapered spindle 273 using suitable hardware (e.g., a roll pin that extends into the roll pin opening 288, a washer 275, and a nut 273) so that the cam 250 may asymmetrically rotate about the central axis of the tapered spindle 273. In various embodiments, such as the embodiment shown in FIGS. 2, 2A, and 5, the cam 250 is installed so that when it rotates in a first direction, the cam's perimeter surface engages, and exerts a lateral force on, the door structure's first bearing 251 in a first lateral direction. This causes the lock bar 220 to move toward, and ultimately into, the unlocked position. Similarly, the cam 250 is installed so that when it rotates in a second direction (e.g., opposite the first direction), the cam's perimeter surface engages and exerts a lateral force on the door structure's second bearing 253 in a second lateral direction that is opposite to the first lateral direction. This causes the lock bar 220 to move toward, and ultimately into, the locked position.

As shown in FIGS. 2, 2A and 5, the cam 250 is substantially planar and has a generally irregular round shape. In particular embodiments, the cam 250 includes a cutout 261 that receives a stop pin 263 that is mounted to the lock bar 220 as shown in FIGS. 2A and 5. As shown in FIG. 5, the stop pin 263 and the portion of the cam 250 that defines the cutout 261 serves to limit the rotation of the cam 250 to a maximum of about 90 degrees (or any other desired angle) in the clockwise/counterclockwise directions.

In various embodiments, the cam 250 includes a lip 267 adjacent its first lateral side and a protrusion 265 adjacent its second lateral side. This protrusion 265 and lip 267 cooperate to prevent backdrive of the lock bar 220 (e.g., by someone trying to open the safe 100 by using a screwdriver or other tools to forcibly move the lock bar 220 from the locked to the unlocked position). As may be understood from FIG. 2A (which shows the cam 250 in the locked position), if a user were to try to force the lock bar 220 into the unlocked position (e.g., to the left in FIG. 2A), the first bearing 251 would exert a lateral force on the downwardly sloped upper surface of the cam's protrusion 265 adjacent the cam's second lateral side. This, in turn, would exert a clockwise rotational force on the cam 250, which would be counterbalanced by the safe's stop pin 263. As a result, the cam 250 would remain in the locked position and would act to physically prevent the lateral movement of the lock bar 220 into the unlocked position.

It should be noted that, as part of the assembly process, the safe's handle 130 is attached, using suitable hardware, to the tapered spindle's handle support portion 281 so that, as shown in FIG. 1B, the handle 130 is rotatably mounted adjacent the exterior surface of the safe's door 200.

Safe Lock

In particular embodiments of the invention, the safe 100 includes a suitable lock 218 (e.g., a safe combination lock, which may include a suitable keypad 106) for selectively locking the lock bar 220 in the locked position. In particular embodiments, the lock 218 is mounted to the safe's rectangular mounting plate 269 above the lock bar's lock engaging tab 241 adjacent an upper recess 247 that is defined by the tab (see FIGS. 2B and 4). As shown in FIG. 2B, the lock 218 includes a retractable locking mechanism 219 that is configured to slide between: (1) a retracted, "unlocked" orientation, which is shown in FIG. 2B, in which the locking mechanism 219 does not prevent the movement of the lock bar 220 from the locked position to the unlocked position; and (2) an extended, "locked" orientation in which the locking mechanism 219 extends into the lock engaging tab's upper recess 247, and thereby prevents the movement (e.g., lateral movement) of the lock bar 220 from the locked position to the unlocked position.

In particular embodiments, such as the embodiment shown in FIGS. 2C and 9, the safe lock 218 is mounted within a substantially U-shaped metal pan 335 that is bolted in place adjacent the lock bar 220 as shown in these figures. As may be understood from FIGS. 2B, 2C, and 9, the bottom surface of the pan 335 extends between the lock bar's lock engaging tab 241 and the relock mechanism's spring-loaded pin 252. Accordingly, in normal operation, the pan 335 maintains the relock mechanism's spring-loaded pin 252 out of engagement with the lock bar 220 and out of a lower recess 249 defined by the lock bar's lock engaging tab 241.

However, if the safe's lock 218 and pan 335 are moved from their installed position (e.g., if a criminal somehow punches the lock 218 and pan 335 into the safe's interior when the lock bar 220 is in the locked position shown in FIG. 2B), the pan 335 will no longer prevent the upward movement of the spring-loaded pin 252. As a result, the spring-loaded pin 252 will move into the lower recess 249 defined by the lock bar's lock engaging tab 241 as shown in FIG. 2B. As may be understood from this figure, when the spring-loaded pin 252 is in this, extended orientation, it prevents the movement (e.g., lateral movement) of the lock bar 220 from the locked position to the unlocked position. Accordingly, the safe 100 will stay locked despite the absence of its primary lock 218.

Operation of Exemplary Locking Mechanisms

To operate gun safes according to various embodiments of the invention, a user begins by unlocking the safe. In various embodiments, this is done by entering a code on a combination lock keypad 106 mounted on the exterior surface of the safe's door (see FIG. 1B, which shows a keypad 106 that is disposed on a circular base on the front surface of the safe's door 200). In response to the correct combination being entered on the keypad 106, the safe lock 218 unlocks the lock bar 220 as described above. This allows the lock bar 220 to be able to slide laterally from the locked position to the unlocked position.

After the lock bar 220 is unlocked, the user rotates the safe's handle 130 clockwise, which causes the cam 250 to rotate from the locked position shown in FIGS. 2 and 2A to the unlocked position, shown in solid lines in FIG. 5. The rotation of the cam 250 from the locked to the unlocked position causes the perimeter of the cam to exert lateral forces on the safe's second bearing 253 in a direction away from the door's first strike plate 341. This, in turn, causes the lock bar 220 to slide away from the door's first strike plate 341 so that the lock bar's various elongated tabs 222, 224, 226, 228, 230, 232, 234, 236 are no longer disposed within their respective cutouts in the first strike plate 320, 322, 324, 326, 328. As a result, the safe's door 200 becomes free to rotate about the safe's hinges 110, 115. The user may then open the safe's door 200 by pulling the safe's handle 130 toward them, which causes the safe's door 200 to rotate open about its hinges 110, 115 and to thereby permit the user to access the safe's interior.

After the user retrieves any items that they need from within the safe's interior (and/or has stored items within the safe's interior), the user pushes the safe's door 200 toward the safe's body until the door 200 is in the closed position. During this process, the door 200 rotates about its hinges 110, 115 and the safe's various lock brackets 206, 208, 210, 212, 214 move so that their respective elongate, substantially planar tabs are positioned within the respective cutouts 330, 332, 334, 336, 338 in the second strike plate 344.

The user then rotates the safe's handle 130 in the counterclockwise direction to rotate the cam 250 from the unlocked position, shown in solid lines in FIG. 5 to the locked position shown in FIGS. 2 and 2A. The rotation of the cam 250 from the unlocked to the locked position causes the perimeter of the cam 250 to exert lateral forces on the safe's first bearing 251 in a direction toward the door's first strike plate 341. This, in turn, causes the lock bar 220 to slide toward the door's first strike plate 341 so that the lock bar's various elongated tabs 222, 224, 226, 228, 230, 232, 234, 236 move into their respective cutouts 341 in the first strike plate 320, 322, 324, 326, 328. Once the lock bar 220 is in the fully locked position (e.g., when the user can turn the handle 130 no further in the counterclockwise direction), the user may lock the safe 100 by, for example, making an appropriate entry on the safe's combination keypad 106. In an alternative embodiment, the safe may lock automatically when certain conditions are met.

Additional Comments on Exemplary Embodiments

As may be understood from the discussion above, in particular embodiments, the safe 100 is provided with an array of lock tabs on each lateral side of the safe's door 200 that engage the safe's housing (or other suitable structure) to, for example, prevent the door 200 from being pried open. These lock tabs may include, for example, the lock bar's various elongated tabs 222, 224, 226, 228, 230, 232, 234, 236 and the tabs of the safe's various lock brackets 206, 208, 218, 212, 214. In particular embodiments, the cumulative vertical length of the lock tabs adjacent a first lateral side of the safe's door 200 is at least about 20%, at least about 30%, at least about 40%, at least about 50%, at least about 60%, and/or at least about 70% of the vertical length of the first lateral side of the door 200. In such embodiments and other embodiments, the cumulative vertical length of the lock tabs adjacent a second lateral side of the safe's door 200 may be, for example, at least about 20%, at least about 30%, at least about 40%, at least about 50%, at least about 60%, and/or at least about 70% of the vertical length of the second lateral side of the door 200.

Also, in particular embodiments, when the safe 100 is locked, the safe's lock tabs span at least about 10%, at least about 20%, at least about 30%, and/or at least about 40% of the total perimeter of the safe's door 200. For example, in the embodiment shown in FIG. 2, if the total perimeter of the door were 160" and the total vertical height of the lock tabs on each lateral side of the safe's door 200 were 20", the safe's lock tabs would span 25% (i.e., [(20"*2)/160"]*100) of the total perimeter of the safe's door 200.

The safe's lock tabs may be, for example, made of a durable metal such as steel. In particular embodiments, each of the lock tabs are substantially planar and extend at least ½", ¾", and/or 1" into a respective recess in a strike plate when the safe's door 200 is in a closed position and the safe 100 is locked. In particular embodiments, the lock tabs are at least ¼", ⅜", or ½" thick.

It should be understood that while various embodiments described above are described as including "dead" bolts adjacent the hinged lateral side of the safe's door 200, other embodiments may include "live" bolts adjacent both of the door's lateral sides. This may be done, for example, by providing the safe 100 with a second lock bar (e.g., that is functionally similar to the lock bar 220 discussed above) adjacent the hinged lateral side of the safe's door 200. This second lock bar may be mechanically linked, for example, to the safe's first lock bar 220 so that the first and second lock bars 220 lock and unlock in tandem.

By the same token, although various embodiments described above are described as providing lock tabs adjacent the lateral sides of the safe's door 200, in other embodiments, such lock tabs may also, or alternatively, be provided adjacent the top and/or bottom sides of the safe's door 200. Also, while various locking mechanisms described herein are described as being used in conjunction with safes, such as gun safes, the locking mechanisms may be used in conjunction with other types of secure enclosures.

Conclusion

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. Also, although most, if not all, of the parts described herein may be suitably made of metal (e.g., steel), it should be understood that various components may comprise any other suitable materials. Therefore, it is to be understood that the invention is not to be limited to the specific embodiments disclosed and that modifications and other embodiments are intended to be included within the scope of the appended exemplary concepts. Although specific terms are employed herein, they are used in a generic and descriptive sense only and not for the purposes of limitation.

What is claimed is:

1. A safe comprising:

a housing defining an interior portion and a safe access opening;

a door disposed adjacent said safe access opening, said door being mounted to move between: (1) a closed position, in which said door prevents access to said interior portion through said safe access opening; and (2) an open position, in which said door does not prevent access to said interior portion through said safe access opening;

an irregularly shaped cam disposed adjacent an interior portion of said door, wherein:

said irregularly shaped cam defines a cam perimeter surface; and said irregularly shaped cam is configured to asymmetrically rotate about an axis of rotation of said cam; and a locking mechanism for maintaining said door in said closed position, wherein:

said locking mechanism comprises:

a lock bar defining at least one elongated tab, said lock bar being mounted to slide between: (1) a locked position, in which at least a particular portion of said elongated tab is disposed in a tab receiving opening defined by said housing; and (2) an unlocked position, in which said particular portion of said elongated tab is not disposed in said tab receiving opening, wherein said at least one elongated tab is substantially rectangular;

a first bearing mounted adjacent said lock bar adjacent a first lateral side of said irregularly shaped cam; and a second bearing mounted adjacent said lock bar adjacent a second lateral side of said irregularly shaped cam; wherein:

said irregularly shaped cam is installed in said safe so that when said irregularly shaped cam rotates in a first direction, said cam perimeter surface engages with and exerts a first lateral force on said first bearing in a first lateral direction, causing said lock bar to move toward, and ultimately into, said unlocked position; and said irregularly shaped cam is installed in said safe so that when said irregularly shaped cam rotates in a second direction, said cam perimeter surface engages with and exerts a second lateral force on said second bearing in a second lateral direction, causing said lock bar to move toward, and ultimately into, said locked position.

2. The safe of claim 1, wherein:

said elongated tab is a first tab;

said lock bar further defines a second tab, wherein said second tab is substantially rectangular;

said tab receiving opening defined by said housing is a first tab receiving opening;

said housing defines a second tab receiving opening; and when said lock bar is in said locked position, at least a particular portion of said second elongated tab is disposed within said second tab receiving opening.

3. The safe of claim 1, wherein:

said safe is a gun safe; and said interior portion comprises at least one substantially circular, substantially horizontal rotatable gun support member.

4. The safe of claim 1, wherein:

said housing comprises a door frame portion that is positioned so that, when said door is in said closed position, said door frame portion is disposed adjacent said elongated tab; and said tab receiving opening defined by said housing is a cutout defined by said door frame portion.

5. The safe of claim 4, wherein:

said tab receiving opening defined by said housing is a first tab receiving opening;

said housing further defines a second tab receiving opening;

said elongated tab is disposed adjacent a first lateral side of said door;

said safe comprises at least one lock bracket disposed adjacent a second lateral side of said door, said lock bracket defining an elongated locking portion that is dimensioned and positioned so that when said door moves from said open position to said closed position, said lock bracket moves from (1) a first position in which a particular portion of said lock bracket's elongated locking portion is not disposed within said second tab receiving opening; and (2) a second position in which said particular portion of said lock bracket's elongated locking portion is disposed within said second tab receiving opening, wherein said locket bracket is in said second position when said lock bar is in the unlocked position.

6. The safe of claim 1, wherein:

said safe further comprises a support that extends through both said irregularly shaped cam and a cutout that is defined by said lock bar; and said irregularly shaped cam is:

substantially heart-shaped; and adapted to rotate about a central axis of said support.

7. The safe of claim 6, wherein said support is a tapered spindle comprising:

a substantially cylindrical handle support portion;

a substantially cylindrical ring cut-off portion; and a tapered portion in the shape of a conical fustrum.

8. The safe of claim 6, wherein:

said support extends through said door; and said safe comprises a handle that is attached adjacent an exterior portion of said door, said handle being mounted rotatably drive both said support and said irregularly shaped cam, and to thereby slide said lock bar adjacent said door.

9. The safe of claim 1, wherein:

said safe further comprises a lock bar support that defines a first cutout and a second cutout;

said elongated tab is a first tab;

said lock bar further defines a second elongated tab;

said lock bar is slidably mounted on said lock bar support so that: (1) said first tab slides within said first cutout as said lock bar slides between said locked position and said unlocked position; and (2) said second tab slides within said second cutout as said lock bar slides between said locked position and said unlocked position.

10. The safe of claim 9, wherein said lock bar support is substantially T-shaped.

11. The safe of claim 9, wherein:

said lock bar support is a first lock bar support;

said safe further comprises a second lock bar support;

said lock bar defines a lock bar cutout that is spaced apart from said first and second elongated tabs; and said lock bar is mounted so that said second lock bar support extends through said lock bar cutout, and so that said lock bar slides on said second lock bar support as said lock bar moves between said locked position and said unlocked position.

12. The safe of claim 11, wherein said lock bar cutout is substantially T-shaped.

13. The safe of claim 1, wherein:
said cam defines:
a lip adjacent a first lateral side of said cam; and
a protrusion adjacent a second lateral side of said cam; and
said protrusion and said lip are configured to cooperate to prevent backdrive of said lock bar.

14. The safe of claim 13, wherein:
said cam defines a stop pin cutout;
said lock bar comprises a stop pin that extends substantially perpendicularly from said lock bar and is disposed at least partially within said stop pin cutout;
said lock bar is configured such that said first bearing, in response to an attempt by a user to force said lock bar into said unlocked position, exerts a lateral force on a downwardly sloped upper surface of said protrusion causing:
said first bearing to exert a rotational force on said cam; and
at least a portion of said cam that defines said stop pin cutout to exert a force that counterbalances said rotational force on at least a portion of said stop pin; and
said cam is configured to prevent lateral movement of said lock bar into said unlocked position in response to said attempt by said user to force said lock bar into said unlocked position.

15. The safe of claim 14, wherein:
said at least a portion of said cam that defines said stop pin cutout and said at least a portion of said stop pin are configured to cooperate to limit a rotation of said cam to about 90 degrees.

16. A safe comprising:
a housing defining an interior portion and an opening;
a door disposed adjacent said opening, said door being mounted to move between:
(1) a closed position, in which said door prevents access to said interior portion; and (2) an open position, in which said door does not prevent access to said interior portion; and
a locking mechanism for maintaining said door in said closed position, wherein:
said locking mechanism comprises:
a lock bar defining a plurality of elongated lock bar tabs, said lock bar being mounted to slide between: (1) a locked position, in which at least a particular portion of each respective one of said elongated lock bar tabs is disposed in a respective opening defined by said housing; and (2) an unlocked position, in which said respective particular portions of said respective lock bar tabs are not disposed in said respective openings; and
an irregularly shaped cam disposed adjacent an interior portion of said door, wherein:
said irregularly shaped cam defines:
a lip adjacent a first lateral side of said cam;
a protrusion adjacent a second lateral side of said cam;
a cam perimeter surface; and
said irregularly shaped cam is positioned and dimensioned so that rotating said irregularly shaped cam between a first orientation and a second orientation causes said lock bar to move between said locked position and said unlocked position;
a first bearing mounted adjacent said lock bar and disposed adjacent said protrusion when said lock bar is in said locked position;
a second bearing mounted adjacent said lock bar and disposed adjacent said lip when said lock bar is in said locked position; wherein:
said plurality of lock bar tabs are positioned in a vertical array adjacent a first lateral side of said door, wherein each of said plurality of elongated lock bar tabs are substantially rectangular in shape;
said irregularly shaped cam is installed in said safe so that when said irregularly shaped cam rotates in a first direction toward said first orientation, said cam perimeter surface engages with and exerts a first lateral force on said first bearing in a first lateral direction, causing said lock bar to move toward, and ultimately into, said unlocked position; and
said irregularly shaped cam is installed in said safe so that when said irregularly shaped cam rotates in a second direction toward said second orientation, said cam perimeter surface engages with and exerts a second lateral force on said second bearing in a second lateral direction, causing said lock bar to move toward, and ultimately into, said locked position.

17. The safe of claim 16, wherein a cumulative vertical length of said plurality of lock bar tabs is at least about 10% of the vertical length of said door.

18. The safe of claim 17, wherein said cumulative vertical length of said plurality of lock bar tabs is at least about 25 30% of the vertical length of said door.

19. The safe of claim 17, wherein:
said safe comprises a vertical array of lock tabs adjacent a second lateral side of said door, each of said lock tabs being adapted and positioned to lockably engage said housing when said door is in said closed position;
each of said lock tabs have a substantially L-shaped cross-section; and
a cumulative vertical length of said plurality of lock tabs is at least about 15% of the vertical length of said door.

20. The safe of claim 19, wherein:
said vertical array of lock tabs and said vertical array of lock bar tabs cumulatively span at least about 10% of the total perimeter of the safe's door;
said irregularly shaped cam is substantially heart-shaped; and
said interior portion of said housing comprises at least one substantially circular shelf.

21. A safe comprising:
a housing defining an interior portion and an opening;
a door disposed adjacent said opening, said door:
being mounted to move between: (1) a closed position, in which said door prevents access to said interior portion; and (2) an open position, in which said door does not prevent access to said interior portion; and
defining a substantially circular opening in a central portion of the door;
a handle operatively connected to a tapered spindle that extends through the opening in the central portion of the door; and
a locking mechanism for maintaining said door in said closed position, wherein:
said locking mechanism comprises:
a lock bar, manufactured as a single piece, defining a plurality of substantially rectangular, substantially planer elongated lock bar tabs positioned in a vertical array adjacent a first lateral side of said door, said lock bar being mounted to slide between: (1) a locked position, in which at least a particular portion of each respective one of said substantially rectangular, substantially planer elongated lock bar tabs is disposed in a respective opening defined by said housing; and (2) an unlocked position, in which said respective particular portions of said respective substantially rectangular, substantially planer elongated lock bar tabs are not disposed in said respective openings;

an irregularly shaped cam operatively attached to said tapered spindle, said cam:

comprising a lip on one lateral side and a protrusion on the opposite lateral side so that rotating said handle rotates said irregularly shaped cam between a first orientation and a second orientation, which causes said lock bar to move between said locked position and said unlocked position; and defining a stop pin cutout;

a first bearing mounted adjacent said lock bar and disposed adjacent said protrusion when said lock bar is in said locked position;

a second bearing mounted adjacent said lock bar and disposed adjacent said lip when said lock bar is in said locked position;

a stop pin that extends substantially perpendicularly from said lock bar and is disposed at least partially within said stop pin cutout;

a vertical array of L-shaped lock tabs adjacent a second lateral side of said door, each of said L-shaped lock tabs being adapted and positioned to lockably engage said housing when said door is in said closed position;

at least one elongated lock bar tab of the plurality of elongated lock bar tabs has a vertical length that is at least twice the length of one other elongated lock bar tab of the plurality of lock bar tabs;

said lip and said protrusion of said cam are positioned to operatively prevent a user from moving said cam from said second orientation to said first orientation without rotating said handle;

a cumulative vertical length of said plurality of substantially rectangular, substantially planer elongated lock bar tabs is at least about 15% of the vertical length of said first lateral of side said door; and a cumulative vertical length of said plurality of L-shaped lock tabs is at least about 15% of the vertical length of said second lateral said of said door, wherein:

said protrusion and said lip are configured to cooperate to prevent backdrive of said lock bar;

said lock bar is configured such that said first bearing, in response to an attempt by a user to force said lock bar into said unlocked position, exerts a lateral force on a downwardly sloped upper surface of said protrusion causing:

said first bearing to exert a rotational force on said cam;

and at least a portion of said cam that defines said stop pin cutout to exert a force that counterbalances said rotational force on at least a portion of said stop pin; and said cam is configured to prevent lateral movement of said lock bar into said unlocked position in response to said attempt by said user to force said lock bar into said unlocked position.

22. The safe of claim 21, wherein said tapered spindle comprises:

a substantially cylindrical handle support portion;

a substantially cylindrical ring-cut off portion; and a tapered portion in the shape of a conical fustrum.

* * * * *